United States Patent [19]

Carieri

[11] 4,014,356

[45] Mar. 29, 1977

[54] CLEANING SYSTEM FOR DISHWARE AND RELATED ITEMS

[76] Inventor: Carl R. Carieri, 64 Autumn Ridge Road, Trumbull, Conn. 06611

[22] Filed: Aug. 27, 1975

[21] Appl. No.: 608,224

[52] U.S. Cl. ..... 134/63; 134/104; 100/117

[51] Int. Cl.[2] ..... B08B 3/10; B08B 1/00; B08B 5/00

[58] Field of Search ..... 134/63, 104, 115 R, 134/115 G, 132; 100/117

[56] References Cited

UNITED STATES PATENTS

| | | | |
|---|---|---|---|
| 2,163,977 | 6/1939 | Ferry | 134/104 |
| 3,075,215 | 1/1963 | Marve | 134/115 G X |
| 3,486,939 | 12/1969 | Pinckard | 134/63 X |
| 3,698,407 | 10/1972 | Noren | 134/115 G X |

FOREIGN PATENTS OR APPLICATIONS

| | | | |
|---|---|---|---|
| 974,582 | 2/1961 | Germany | 100/117 |
| 489,668 | 1/1930 | Germany | 134/132 |

*Primary Examiner*—Robert L. Bleutge

[57] ABSTRACT

The invention is for a cleaning system for dishware and related items including a combination compacting means with conveying, washing, rinsing and drying means. The compacting means includes a trough, a screw conveyor and a source of air current for separating solid and liquid waste and compacting the same, the liquid waste being suitably disposed of by forcible disposal through a foraminous subfloor in the trough.

4 Claims, 4 Drawing Figures

CLEANING SYSTEM FOR DISHWARE AND RELATED ITEMS

BACKGROUND OF THE INVENTION

This invention relates to cleaning systems. More particularly, the invention relates to a system for cleaning dishware and related items which are generally used in large scale operations such as hospitals, restaurants, cafeterias and the like where large quantities of dishes and the like normally must be handled.

In large scale dishware cleaning systems useful in operations such as those mentioned above, the relatively large amount of waste material which must be disposed of in an efficient manner results in the need for a system including means for collecting and preparing the waste material from further disposition. In most cases the waste material is solid food waste and liquid waste. Moreover, such solid food waste in most cases includes a high liquid content.

Known cleaning systems useful in such operations usually include cooperating conveying, washing, rinsing and drying means. However, in the known systems dishware and the like which is to be cleaned is usually subjected to a manual preliminary operation in which the bulk of any waste material is collected simply by being wiped or brushed from the item being cleaned into a waste container for further disposal when the container is full or pulping and grinding units. Such disposition of the waste material, although generally satisfactory, exhibits various disadvantages.

For example, the waste is not treated in any manner to separate the solid and liquid portions from each other or to separate course and fine solid particles from each other. However, in such large volume operations a more efficient waste collection operation is desirable.

One way of accomplishing this desirable end result is to compact the waste material in a compacting device. However, compacting such materials when they contain relatively large amounts of liquid clearly is of limited efficiency since the liquid materials will occupy a relatively large volume of the compactor capacity. The present invention, on the other hand, obviates such disadvantages.

THE DRAWINGS

In order to fully understand the present invention, reference is directed to the following specification which is to be taken in conjunction with the accompanying drawings wherein.

BROAD STATEMENT OF THE INVENTION

In accordance with the invention there is provided an improved system for cleaning dishware and related items and which system includes cooperative conveying, washing, rinsing and drying means and comprising in combination with such means a trough located upstream from the washing means, a screw conveyor located in the trough and compacting means located downstream from the trough to receive material, such as solid food waste conveyed by the screw conveyor thereto for compacting the same.

DESCRIPTION OF THE PREFERRED EMBODIMENTS

Figure 1:
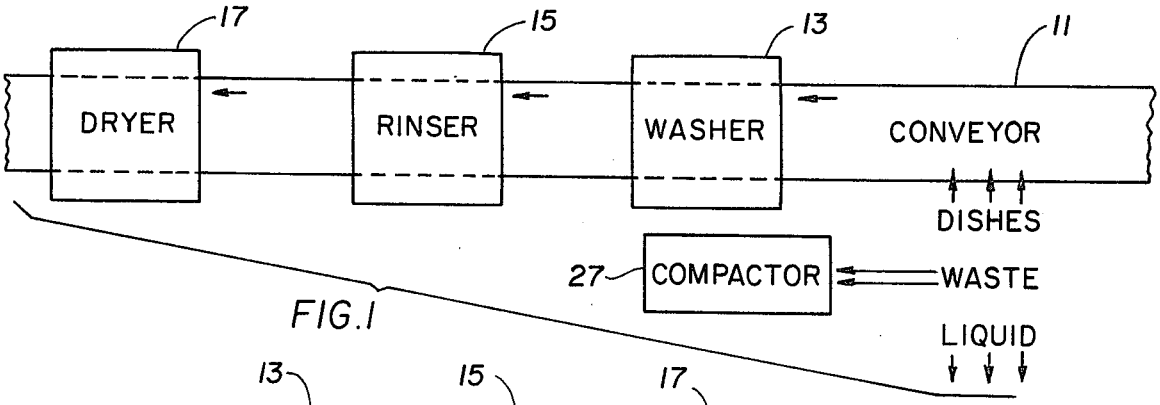
FIG. 1 is an overall schematic view of a cleaning system according to the invention with the generally known conveying, washing, rinsing and drying means shown only diagrammatically.
Figure 2:
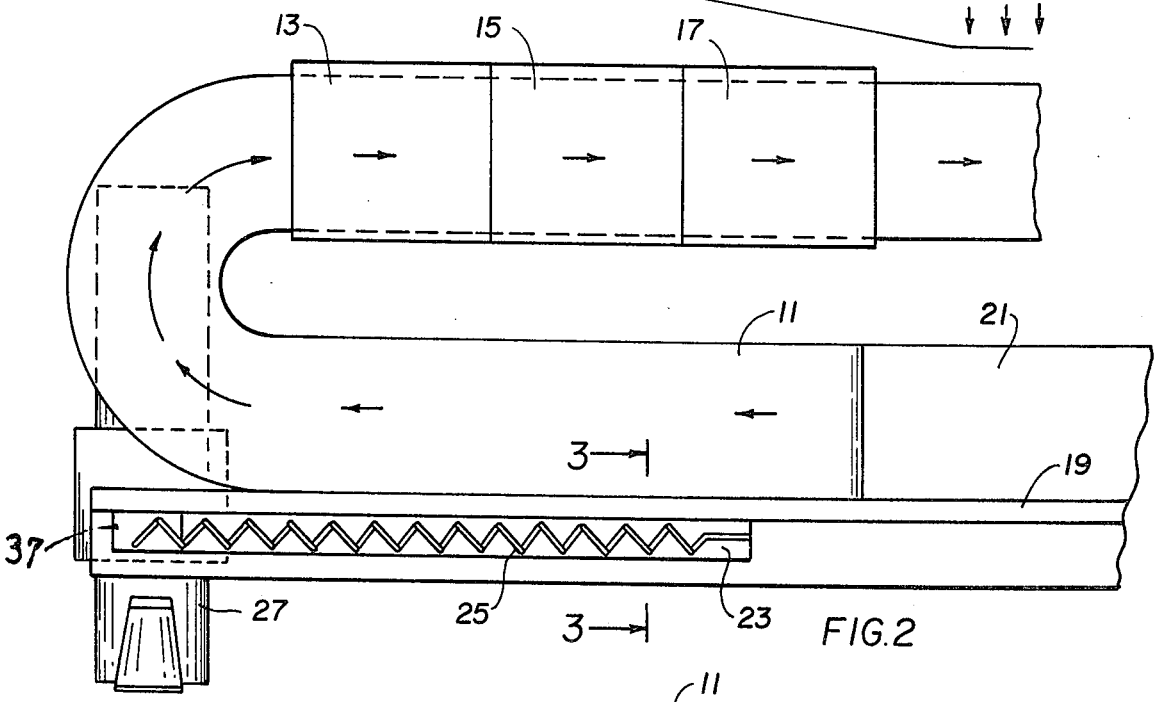
FIG. 2 is a plan view of the system shown in FIG. 1 showing in partial detail the relationship of the screw conveyor and compacting arrangement of the system of the invention.

Referring to FIG. 1 the cleaning system illustrated thereto comprises conveying, washing, rinsing and drying means 11, 13, 15 and 17, respectively and all of which are well known to the art and may have any suitable construction. Located upstream from the washing means is a slanted over-shelf 19 having holes or slots formed therein for drainage of water and trash. A storage rack 21 is formed adjacent the shelf 19. Disposed beneath the over-shelf is a trough, generally depicted by the numeral 23, in which a screw conveyor 25 is located. The conveying means 11 and screw conveyor 25 are powered by suitable driving means such as motors, gears or their transmissions, not shown.

Figure 3:
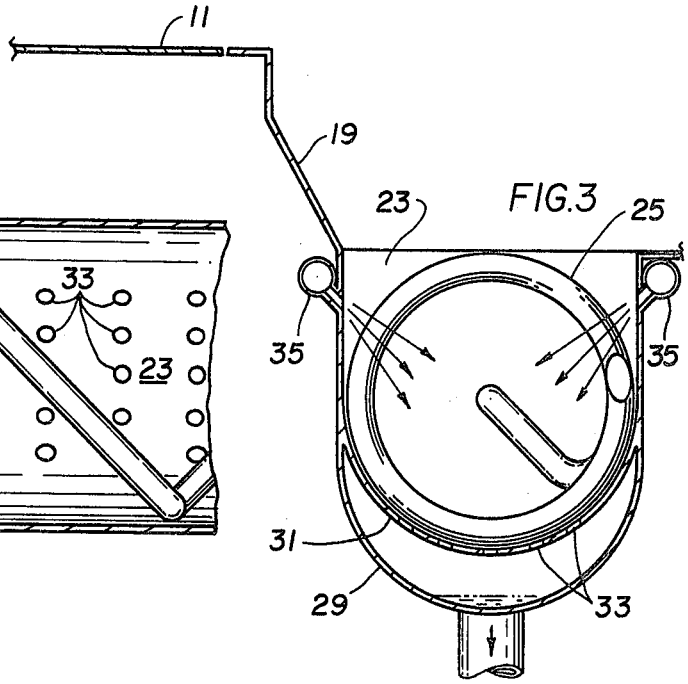
FIG. 3 is a sectional view of the trough illustrating the construction thereof.
Figure 4:
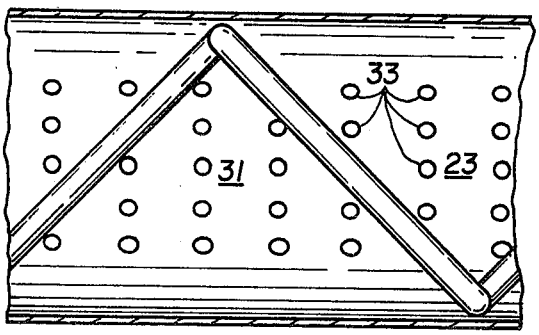
FIG. 4 is a plan view of the trough illustrating the foramina sub-floor thereof.

The trough and screw conveyor 25 lead to a compactor 27 located downstream from the trough, the construction of which is shown more completely in FIGS. 3 and 4.

Turning now to FIG. 3, it can be seen that the trough has an enlarged semi-circular outer wall 29 and a sub-floor 31. The sub-floor is foraminous having a plurality of openings 33, such as shown more particularly in FIG. 4. The trough is suitably connected by a pipe discharged to a suitable liquid collecting system such as a drain (not shown) and is equipped along the outer edge with pneumatic means 35 which forces air or suitable vaporized detergent, deodorizers etc. through the screw conveyor.

The end of the sub-floor 33 debauches into a vertical storage chamber 37, located above inlet opening of the compactor 27. Preferably, the compactor is provided with ram reciprocable in a chamber and movable successively to compact the trash fed through the inlet opening. On the compaction stroke of the ram, the ram itself, having a trailing jacket and skirt, closes the inlet opening preventing the further movement of trash into the compactor, causing the additional trash fed by the screw conveyor to accumulate within the storage chamber 37. On the other hand, a different type of compacting apparatus may be used and a separate door, such as a slidable trap can be placed beneath the storage chamber 37 to close it off during operation of the compactor.

In use the system of this invention operates as follows. An operator removes waste food material from a piece of dishware by wiping or brushing it onto the over-shelf 19 and then into the screw conveyor 25 which normally rotates continually in action and with the pneumatic means activated, if desireable. The rotating screw flight and the pneumatically provided air agitate and force the waste material against the surface of the screw flights, and between it and the surface of the subfloor 33, thus squeezing any liquid waste and fine particles therefrom. The liquid and fine particles pass through the foraminous sub-floor and off to suitable collection means through the pipe discharge. Concurrently, the separated solid waste is led to the storage chamber 37 and thence into the compactor in a relatively dry state. The dishware being so processed are then placed in the storage rack 21 or into the dish cleaning system illustrated and are completely cleaned and dried in the usual manner.

In addition to the screw conveyor, the compactor may alone be conveniently equipped for hand feeding directly through the storage chamber 37. In any event, suitable interlock devices should be provided which stop or arrest operation of the compactor ram when the compactor inlet, or the trap door of the storage chamber 27 is open and being hand fed, so that the likelihood of an accident occurring because of ram operation is removed. The trash will be continually compacted in the packing chamber until approximately a sufficient body has been accumulated (variable from 30 to 100 lbs.-field adjustable). Once the desired weight is reached an unload light is activated and the compactor cycles down. The unit is now ready for unloading which takes approximately one minute. During the unloading process the screw conveyor will continue to run depositing trash into the storage chamber once unloading is completed. The accumulated trash is then released and pushed into the packing chamber when the ram is reactivated.

Any liquids that do manage to reach the compactor are drawn off by the drainage system of the compactor which links the compactor to the building plumbing.

Trash may be compacted into plastic bags or steel containers. The choice will usually depend on volume and logistics.

It will thus be seen that the waste material is conveniently, rapidly and efficiently separated from the liquid waste contained therein in an advantageous and relatively simple manner. The present system is capable of being easily washed down and cleaned to maintain its sanitary condition, and is formed of few parts none of which accumulate waste except the compactor.

Numerous other advantages of the present invention will be readily apparent to those skilled in the art and it is to be understood that numerous variations and modifications of this invention may lie made without distorting from the spirit and scope thereof and this invention is not to be limited except as defined in the appended claims.

What is claimed:

1. In a system for cleaning dish ware and related items which system includes cooperative conveying, washing, rinsing and drying means, the improvement comprising in combination with the said means a trough for receiving refuse located upstream from said washing means, a screw conveyor located in said trough and compacting means located downstream from said trough to receive material conveyed by said screw conveyor thereto for compacting of the same, said trough having a foraminous sub-floor located below the screw conveyor and the openings in the sub-floor are sized to permit passage into said trough of only relatively fine solid particulate matter and liquid matter and including pneumatic means located along the periphery of the trough directed downward through said screw toward the foraminous sub-floor for forcing refuse against the flights of the screw and for agitating the relatively fine particulate and liquid through the foraminous sub-floor material.

2. A system according to claim 1 wherein the trough includes a foraminous sub-floor.

3. A system according to claim 1 including separate means for collecting the liquid matter and fine solid matter from the trough.

4. A system according to claim 1 including a storage hopper interposed between said screw conveyor and said compactor for temporarily storing said waste during operation of said compactor.

* * * * *